US010676993B2

(12) United States Patent
Moore et al.

(10) Patent No.: US 10,676,993 B2
(45) Date of Patent: Jun. 9, 2020

(54) DIRECTIONAL DRILLING SYSTEM WITH CARTRIDGES

(71) Applicant: Halliburton Energy Services, Inc., Houston, TX (US)

(72) Inventors: James Wilson Moore, Tomball, TX (US); Scott James Harris, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 42 days.

(21) Appl. No.: 15/761,712

(22) PCT Filed: Oct. 12, 2015

(86) PCT No.: PCT/US2015/055078
§ 371 (c)(1),
(2) Date: Mar. 20, 2018

(87) PCT Pub. No.: WO2017/065723
PCT Pub. Date: Apr. 20, 2017

(65) Prior Publication Data

US 2018/0340374 A1 Nov. 29, 2018

(51) Int. Cl.
*E21B 7/06* (2006.01)
*E21B 47/00* (2012.01)

(52) U.S. Cl.
CPC ..... *E21B 7/062* (2013.01); *E21B 7/06* (2013.01); *E21B 7/067* (2013.01); *E21B 7/068* (2013.01); *E21B 47/00* (2013.01)

(58) Field of Classification Search
CPC ..... E21B 7/06; E21B 7/068
See application file for complete search history.

(56) References Cited

U.S. PATENT DOCUMENTS 6,116,354 A * 9/2000 Buytaert ..... E21B 17/1014 175/55
6,564,883 B2 5/2003 Fredericks et al.
7,267,184 B2 9/2007 Helms et al.
7,762,356 B2 7/2010 Turner et al.
7,926,592 B2 4/2011 Smith et al.
8,302,705 B2 * 11/2012 Downton ..... E21B 17/1014 175/74
8,534,380 B2 9/2013 Downton
(Continued)

FOREIGN PATENT DOCUMENTS

WO 2015003266 A1 1/2015

OTHER PUBLICATIONS

PCT International Search Report and Written Opinion dated Jul. 11, 2016, issued in corresponding application No. PCT/US2015/055078 filed on Oct. 12, 2015, 14 pgs.

*Primary Examiner* — Cathleen R Hutchins
(74) *Attorney, Agent, or Firm* — Chamberlain Hrdlicka

(57) ABSTRACT

A directional drilling system includes a housing and a motor positioned within the housing and operably coupled to a drill bit to rotate the drill bit. The system further includes a primary pad assembly comprising a primary pad and a primary actuator coupled to the primary pad to selectively extend from an exterior of the housing, and a backup pad assembly to back up the primary pad assembly, the backup pad assembly comprising a backup pad and a backup actuator coupled to the backup pad to selectively extend from the exterior of the housing.

20 Claims, 5 Drawing Sheets

(56) References Cited

U.S. PATENT DOCUMENTS

| | | | |
|---|---|---|---|
| 8,708,064 | B2 | 4/2014 | Downton et al. |
| 8,720,604 | B2 | 5/2014 | Sheppard |
| 2005/0109542 | A1 | 3/2005 | Downton |
| 2009/0044979 | A1 | 2/2009 | Johnson et al. |
| 2014/0097026 | A1 | 4/2014 | Clark et al. |
| 2015/0107902 | A1 | 4/2015 | Downton |

* cited by examiner

DIRECTIONAL DRILLING SYSTEM WITH CARTRIDGES

BACKGROUND

Directional borehole operations, such as directional drilling, involve varying or controlling the direction of a downhole tool (e.g., a drill bit) in a wellbore to direct the tool towards a desired target destination. In directional drilling, for example, the direction of a drill bit is controlled to direct the bit, and the resultant wellbore, towards a desired target destination.

Various techniques have been used for adjusting the direction of a tool string in drilling a borehole. Slide drilling, for example, may be performed using a downhole motor and a bent housing to selectively change the direction in which the borehole is being drilled. Normally, the entire drill string, including the downhole motor and bent housing, is rotated from the surface, for a zero net change in direction (nominally straight drilling). The direction of drilling may be changed by using the downhole motor alone to rotate the bit while drill string rotation is halted, such that the bent housing deflects the bit in the desired direction. When the desired directional change is achieved, rotation of the string from the surface may be resumed.

Slide drilling systems may have challenges related to halting drill string rotation. For example, a non-rotating drill string is subject to buckling in the wellbore and reduced hole cleaning efficiency.

In contrast to slide drilling systems, directional drilling systems typically have an adjustable housing angle that may be dynamically controlled while drilling to effectively steer the borehole being drilled. This allows the entire drill string to continue rotating while changing the direction of the borehole. By maintaining drill string rotation, directional drilling systems overcome various deficiencies of slide drilling.

An example of a tool for controlling deflection in a directional drilling system (i.e. a rotary steerable module) typically includes a shaft that rotates with the drill string surrounded by a housing that deflects the shaft thereby pointing the bit, an internally rotatable articulated coupling of two shafts (Point the Bit), or a fully rotating or partially geo-stationary device with radial push pads/gauges. By deflecting the shaft, the direction of the downhole end of the shaft is changed to also change the direction of drilling of the drill bit.

BRIEF DESCRIPTION OF THE DRAWINGS

For a detailed description of the embodiments of the invention, reference will now be made to the accompanying drawings in which.

The illustrated figures are only exemplary and are not intended to assert or imply any limitation with regard to the environment, architecture, design, or process in which different embodiments may be implemented.

DETAILED DESCRIPTION

Figure 1:
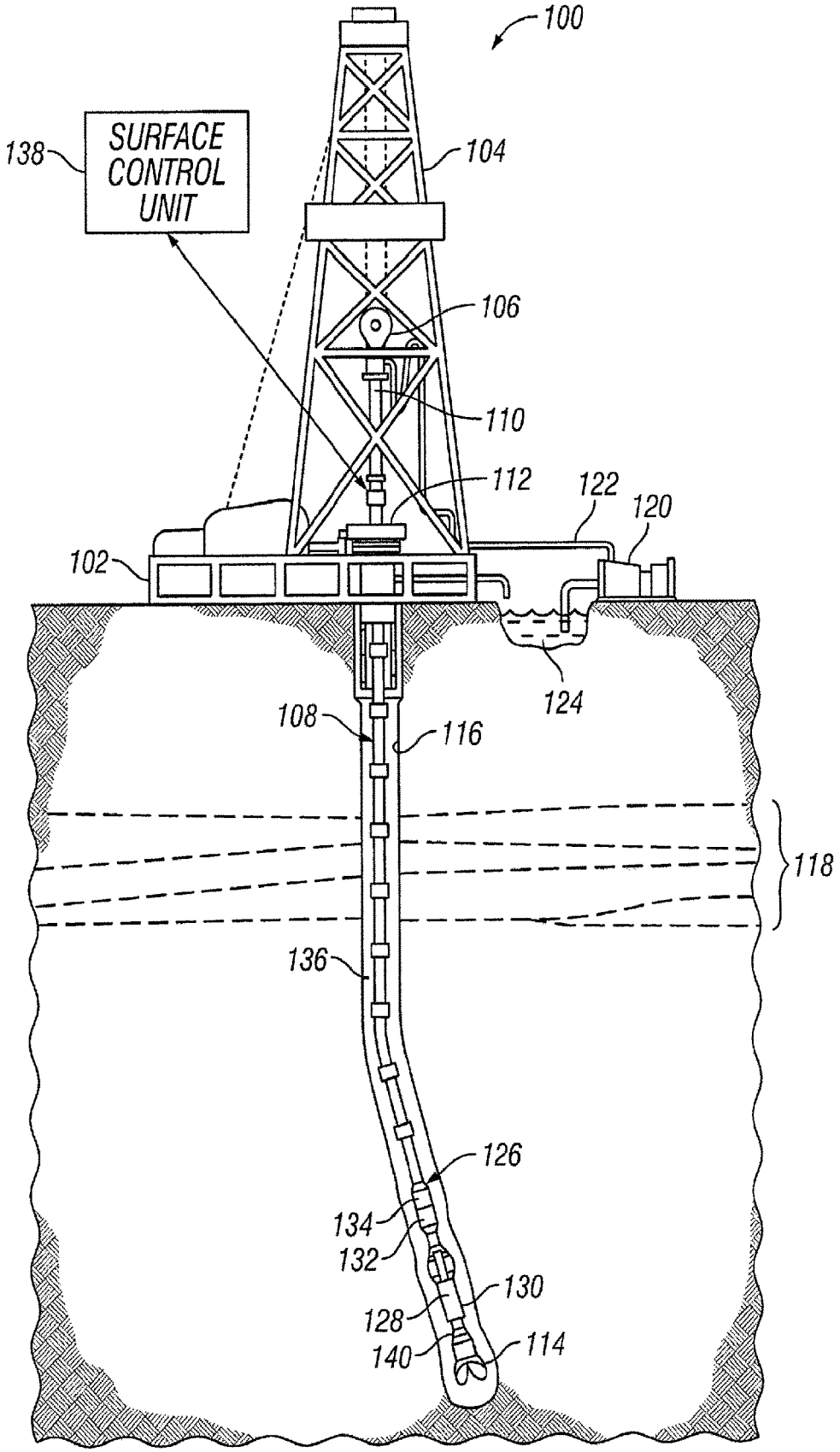
FIG. 1 shows schematic view of a wellbore environment in accordance with one or more embodiments of the present disclosure.

Turning now to the present figures, FIG. 1 shows a well system that can embody principles of the present disclosure. The system of the present disclosure will be specifically described below such that the system is used to direct a drill bit to drill a wellbore within a well, such as a well subsea or on land. Further, it will be understood that the present disclosure is not limited to only drilling an oil well. The present disclosure also encompasses natural gas wellbores or hydrocarbon wellbores in general. Further, the present disclosure may be used for production, monitoring, or injection in relation to the recovery of hydrocarbons or other materials from the subsurface. This could also include geothermal wellbores intended to provide a source of heat energy instead of hydrocarbons. Furthermore, the purpose could be any subterranean drilling such as for water wells, extraction of minerals, such as salts or brines, for placement of communications or power cables underground, or for placement of residential gas piping.

Accordingly, FIG. 1 shows a tool string 126 disposed in a directional borehole 116. The tool string 126 including a directional drilling system 128 in accordance with various embodiments. A drilling platform 102 supports a derrick 104 having a traveling block 106 for raising and lowering a drill string 108. A kelly 110 supports the drill string 108 as the drill string 108 is lowered through a rotary table 112. In some embodiments, a topdrive is used to rotate the drill string 108 in place of the kelly 110 and the rotary table 112. A drill bit 114 is positioned at the downhole end of the tool string 126, and, in one or more embodiments, may be driven by a downhole motor (not shown) positioned in the tool string 126 uphole of the rotary steering tool 128 and/or rotation of the drill string 108 from the surface. As the bit 114 rotates, the bit 114 creates the borehole 116 that passes through various formations 118. A pump 120 circulates drilling fluid through a feed pipe 122 and downhole through the interior of drill string 108, through orifices in drill bit 114, back to the surface via the annulus 136 around drill string 108, and into a retention pit 124. The drilling fluid transports cuttings from the borehole 116 into the pit 124 and aids in maintaining the integrity of the borehole 116.

The tool string 126 may include one or more logging-while-drilling ("LWD")/measurement-while-drilling ("MWD") tools 132 that collect measurements including survey trajectory data, formation properties and various other drilling conditions as the bit 114 extends the borehole 116 through the formations 118. The MWD tool 132 may include a device for measuring formation resistivity, a gamma ray device for measuring formation gamma ray intensity, devices for measuring the inclination and azimuth of the tool string 126, pressure sensors for measuring drilling fluid pressure, temperature sensors for measuring borehole temperature, etc.

The tool string 126 may also include a telemetry module 134. The telemetry module 134 receives data provided by the various sensors of the tool string 126 (e.g., sensors of the MWD tool 132), and transmits the data to a surface control unit 138. Similarly, data provided by the surface control unit 138 is received by the telemetry module 134 and transmitted to the tools (e.g, MWD tool 132, rotary steering tool 128, etc.) of the tool string 126. In some embodiments, mud pulse telemetry, wired drill pipe, acoustic telemetry, or other telemetry technologies know in the art may be used to provide communication between the surface control unit 138 and the telemetry module 134.

The directional drilling system 128 is configured to change the direction of the tool string 126 and/or the drill bit 114, such as based on information indicative of tool 128 orientation and a desired direction of the tool string 126. The directional drilling system 128 includes a housing 130 disposed about a steerable shaft 140. In this embodiment, the steerable shaft 140 transfers rotation through the directional drilling system 128. A deflection or cam assembly surrounding the shaft 140 is rotatable within the rotation resistant housing 130 to orient the deflection or cam assembly such that the shaft 140 can be eccentrically positioned in the borehole causing a change in trajectory. Most embodiments of intelligent directional drilling systems 128 include or are coupled to directional sensors (e.g., a magnetometer, gyroscope, accelerometer, etc.) for determination of azimuth and inclination with respect to a reference direction (e.g., magnetic north) and reference depth. Steering can be automated within the toolstring or sent via telemetry from surface. In either manner, steering is based on measurements comprising the current measured depth, true vertical depth, inclination and azimuth. In one embodiment, the directional drilling system 128 determines a suitable orientation of the deflection sleeve to steer the tool string 126 in the desired direction.

Figure 2:
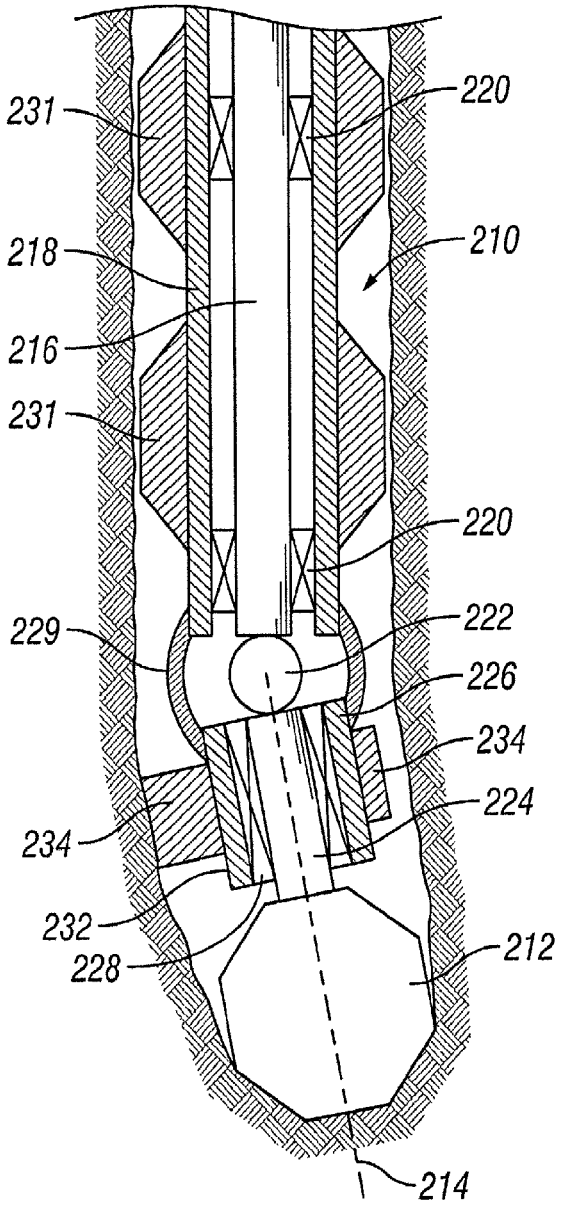
FIG. 2 shows a cross-sectional view of a directional drilling system for drilling a deviated borehole in accordance with one or more embodiments of the present disclosure.

Referring now to FIG. 2, a directional drilling system for use in the formation of a wellbore is shown. The directional drilling system in this embodiment includes a downhole motor 210 arranged to drive a drill bit 212 for rotation about an axis 214 thereof. The motor 210 is a fluid driven motor such that the motor 210 includes a rotor 216 rotatable within a generally cylindrical stator 218. The rotor 216 is supported for rotation within the stator 218 by bearings 220. The outer surface of the rotor 216 and the inner surface of the stator 218 are provided with formations that cooperate with one another to define a series of cavities that are isolated from one another and that progress along the length of the motor 210 as the rotor 216 rotates relative to the stator 218. A progressive cavity motor of this type is sometimes referred to as a Moineau motor.

The stator 218 of the motor 210 may be connected to a drill string to carry and deploy the directional drilling system. The drill string may then also rotate the stator 218 of the motor 210. The rotor 216 is connected through a universal joint 222 to the drive shaft 224 of the drill bit 212.

In this embodiment, the drive shaft 224 extends through a cylindrical housing 226 with bearings 228 provided to support the drive shaft 224 for rotation within the housing 226. The housing 226 is connected to the stator 218 through a flexible drive arrangement 229 that allows the axis of the housing 226 and drive shaft 224 to be angularly displaced relative to the axis of the rotor 216, but may not allow relative rotary movement between the stator 218 and the housing 226 to take place, or at least restricts such movement to a very low level.

The directional drilling system may be provided with stabilizers 231. For example, in this embodiment, the outer surface of the stator 218 is provided with upper and lower stabilizers 231 that engage the formation being drilled to restrict or resist lateral movement of the directional drilling system within the wellbore, holding the directional drilling system generally concentrically within the borehole.

The housing 226 is provided on an outer surface 232 with a plurality of pad assemblies 234. The pad assemblies 234 in this embodiment are each pivotally mounted to the housing 226 so as to be moveable between a retracted position and an extended position. In FIG. 2, the left pad assembly 234 is shown in its extended position and the right hand pad assembly 234 is shown in its retracted position. Actuators (not shown here), such as in the form of pistons, are provided to drive pads of the pad assemblies 234 between the retracted and extended positions. In one embodiment, the actuators may be in fluid communication with a valve or valve arrangement operable under the control of a control unit (not shown) to control the supply of fluid to the actuators and hence to control movement of the pads of the pad assemblies 234. The valve arrangement may be conveniently electrically, for example solenoid, or electromagnetically operated, controlling the supply of fluid ported to the actuators. Such an arrangement allows the control unit to be located remotely, for example above the motor. However, it will be appreciated that other arrangements are possible.

In use, the motor 210 may be held by the drill string against rotation or is arranged to rotate at a low rotary speed. Fluid is supplied under pressure to the drill string, typically by a surface mounted pump arrangement. The fluid is forced through the motor 210 causing the rotor 216 to rotate relative to the stator 218. The rotary motion of the rotor 216 is transmitted through the universal joint 222 to the drive shaft 224, thereby driving the drill bit 212 for rotation. The motion of the drill bit 212, in conjunction with the weight applied to the bit 212, in use, causes the bit 212 to shear material (PDC-bit) or crush (roller cone bit) from the formation. In one embodiment, fluid supplied from surface pumps through the drill string 108 passes through nozzles in the drill bit 214, which subsequently washes away the cuttings volume through the wellbore 116 annulus to the surface pit 124.

When it is determined that a dogleg should be formed in the wellbore 116, the control unit onboard the downhole tool is operated to cause the pad assemblies 234 to selectively extend and retract. For example, when a pad assembly 234 on one side of the housing 224 is moved to its extended position and into engagement with the surrounding formation, this engagement with the borehole wall apply a sideways or laterally acting load to the housing 228 and the drill bit 212, urging the drill bit 212 to scrape or abrade material from a part of the wellbore 116 spaced from the axis thereof to drill a deviated borehole. After the desired deviation or dogleg has been formed within the borehole, the extended pad 234 is allowed to return to its retracted position.

The stator 218 of the motor 210 is typically mechanically coupled to surface RPM via the drill string 108. Two commonly cited states of drilling include drilling while "rotating ahead," where the surface system (110,112, 138) is imparting rotary motion to the drill string 108, stator 218, and axis 214, or "slide [oriented] drilling," where the drill string 108 and stator 218 is held geo-stationary (toolface) by the surface rig controller 138. In both aforementioned cases, energy from the flowing internal bore fluid is converted to additional rotational speed of the drill bit as is shown by the components 212, 214, and 216. Slide drilling may also include oscillating the drill pipe with the surface system 138 when 110 and 112 is replaced by a top-drive. This may be done to aid in mechanical propagation of the drill string 108 while controlling a targeted downhole toolface.

Slide drilling is intended to steer the creation of new wellbore 116 in the desired direction, which by definition creates intentional doglegs. The intent of rotary drilling with a mud motor is usually to drill straight for a specific coarse length, however, doglegs do occur. Dogleg Severity is an average measurement over a specific, albeit relatively long, coarse length of 100 feet or 30 meters (depending on unit convention). For example, when drilling a curved section that has a planned DLS of 10°/100' with a mud motor that is averaging a motor output of 15°/100', the directional driller may alternate rotating coarse lengths and sliding doglegs of varying footage to achieve the average "10's." Due to the strike angle the drill bit makes with the formation, rotating sections will experience doglegs that are commonly decomposed into build rate and turn rate. In these circumstances, it will be appreciated that during the formation of the dogleg in the wellbore the housing 210 will also rotate at a speed (i.e. coupled to surface RPM) and the pad assemblies 234 need to be moved between the retracted and extended positions in turn as the housing 210 rotates in order to form the dogleg in the borehole in the desired direction. In the embodiment of FIG. 2, slide drilling is unnecessary because the controlled action/retraction of pads 234 creates an intentional change in wellbore trajectory even when the motor 120, the stator 218, and the surface system are rotating.

Figure 3:
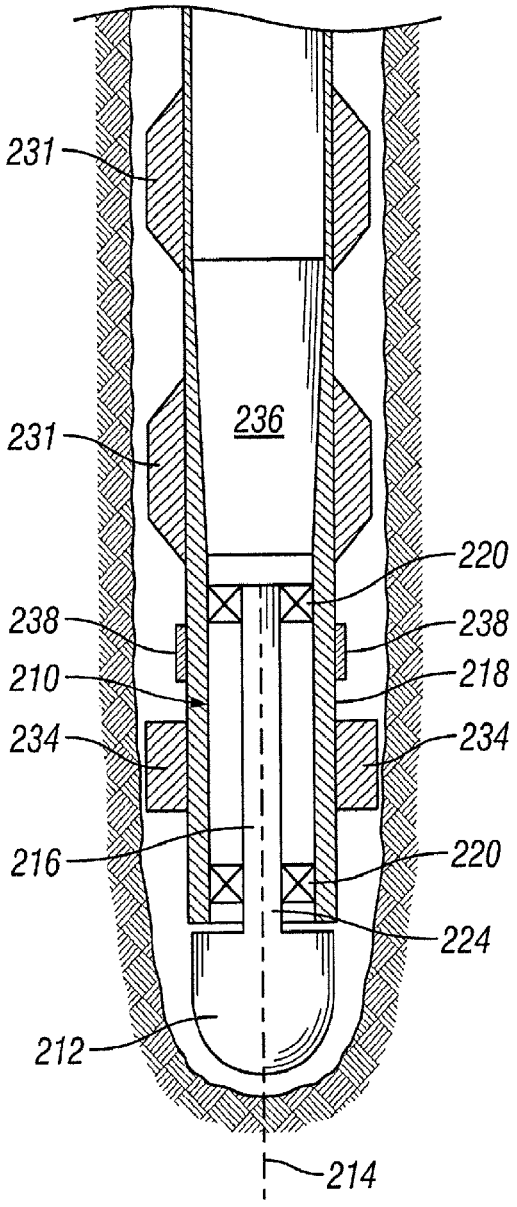
FIG. 3 shows a cross-sectional view of a directional drilling system for drilling a deviated borehole in accordance with one or more embodiments of the present disclosure.

FIG. 3 illustrates a directional drilling system that, in some respects, is similar to the embodiment shown in FIG. 2. In the arrangement of FIG. 3, the rotor 216 and the drive shaft 224 for the drill bit 212 are not connected to one another through a universal joint, but rather are rigidly connected to one another, or integral with one another. The pad assemblies 234 are not pivotally mounted to a housing 232, but rather are mounted upon the stator 218. Operation of this arrangement is similar to that described with reference to FIG. 2, but the pad assemblies are carried by the stator 218 or a sleeve that holds a motor stator/rotor cartridge. In this embodiment the motor 210 is pushed eccentrically within the borehole by the pad assemblies 234 to cause intentional wellbore trajectory change.

The actuators used to drive the pads of the pad assemblies 234 between the retracted and extended positions, in this embodiment, may take the form of pistons to which fluid is supplied under pressure, at the appropriate time, through a valve arrangement controlled by the control unit. The valve arrangement could take the form of a rotary valve controlling the supply of fluid from an inlet to a plurality of outlets, in turn, each of the outlets communicating with a respective one of the actuators. However, this need not be the case and FIG. 3 illustrates an arrangement in which the control unit 236 may control the operation of a plurality of electrical actuators 238 (e.g., bistable, solenoid operated actuators), each of which is associated with the actuator of a respective one of the pad assemblies 234 to control movement of the pads of the pad assemblies 234 between the retracted and extended positions. As the actuators 238 are electrically controlled, this may eliminate the need for additional flow channels and instead be replaced by electrical cables or electrical signals communicated between the actuators 238 and the control unit 236. As mentioned hereinbefore, the actuators could take a range of alternative forms. In one embodiment, a significant benefit of the combination of the Moineau motor cartridge and the push pad directional drilling system is that the interleaved lobes of the stator 218 and rotor 216 create a large pressure drop to increase the differential pressure used by solenoid operated mud valves, thereby increasing the size of a pad 234 pushing force.

Figure 4:
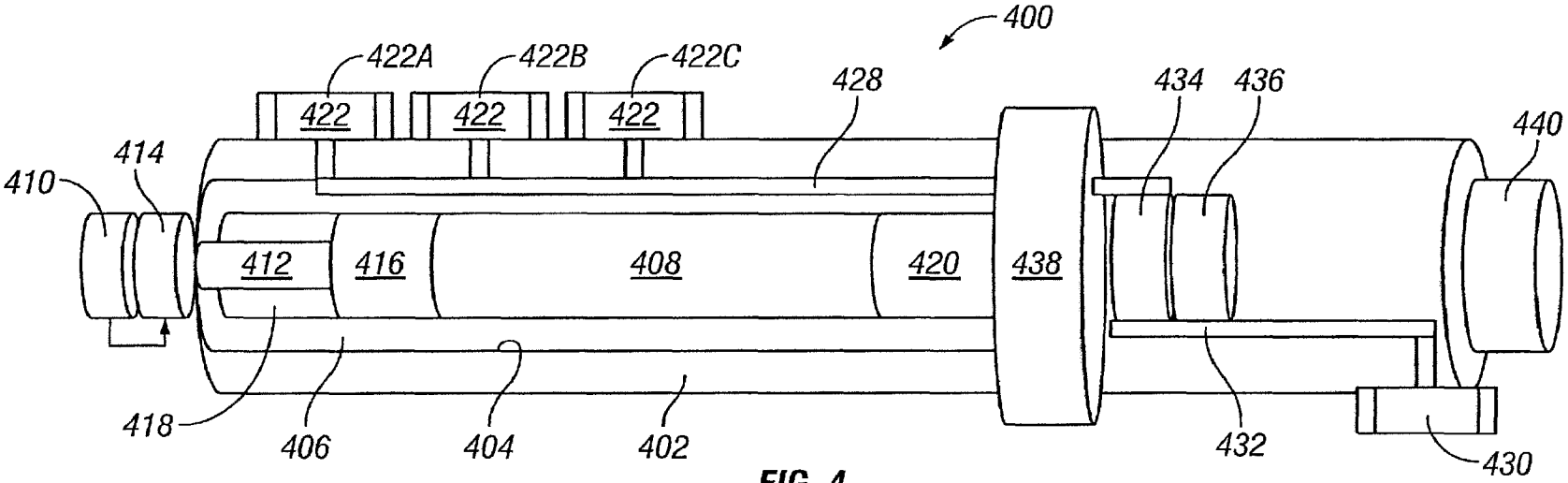
FIG. 4 shows an interior schematic view of a directional drilling system in accordance with one or more embodiments of the present disclosure.
Figure 5:
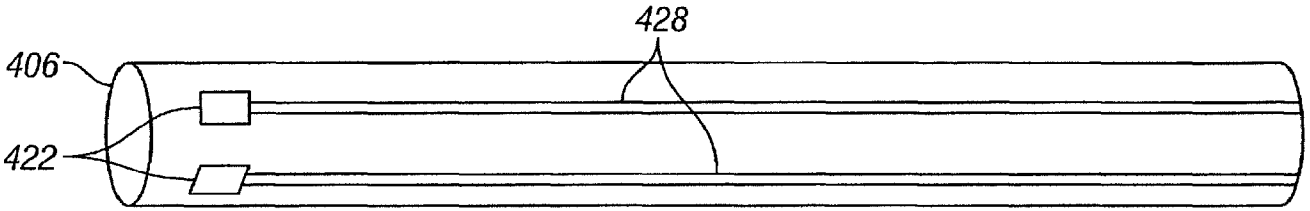
FIG. 5 shows an exterior schematic view of a motor cartridge of a directional drilling system in accordance with one or more embodiments of the present disclosure.
Figure 6:
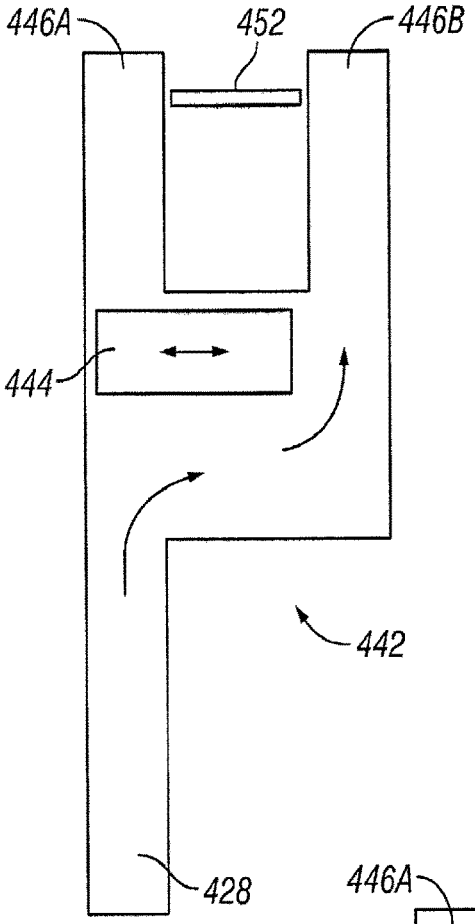
FIG. 6 shows a schematic view of a switching mechanism of a directional drilling system in accordance with one or more embodiments of the present disclosure.
Figure 7:
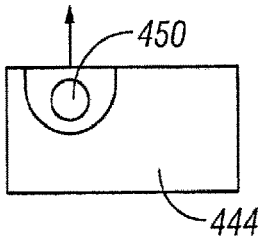
FIG. 7 shows a schematic view of a switching mechanism of a directional drilling system in accordance with one or more embodiments of the present disclosure.
Figure 8:
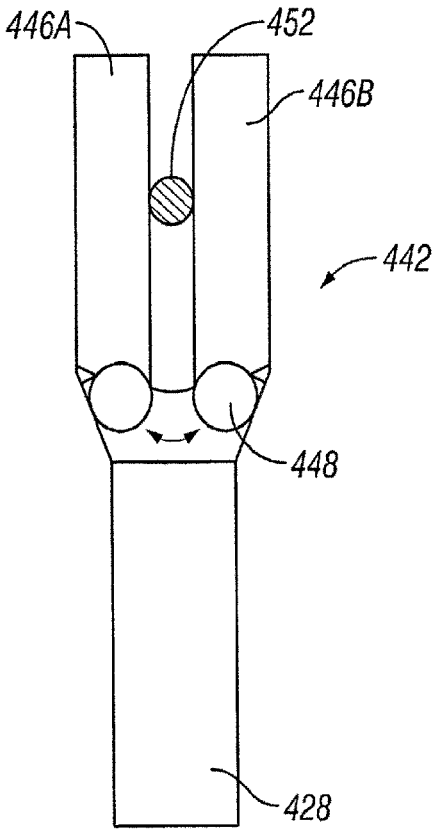
FIG. 8 shows a schematic view of a switching mechanism of a directional drilling system in accordance with one or more embodiments of the present disclosure.
Figure 9:
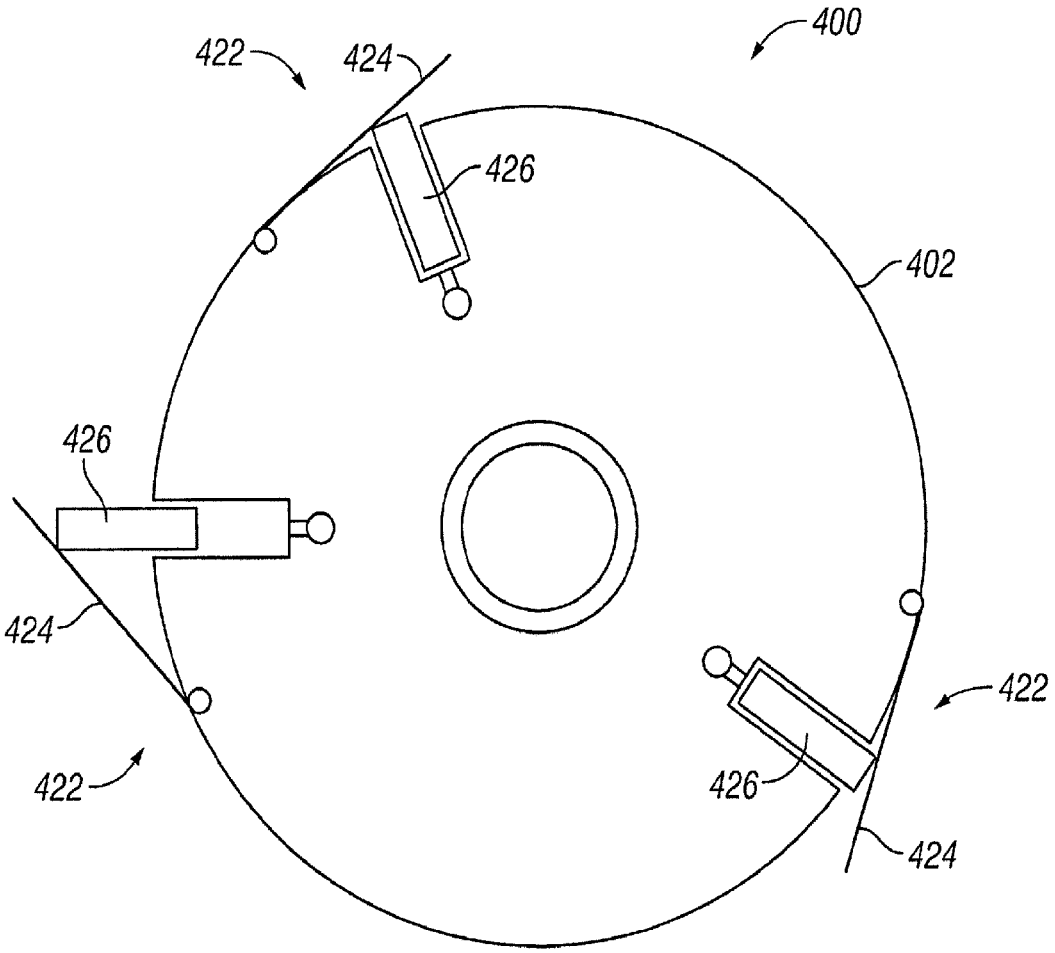
FIG. 9 shows a cross-sectional view of pad assemblies included within a directional drilling system in accordance with one or more embodiments of the present disclosure.

Referring now to FIGS. 4-9, multiple views of a directional drilling system 400 (e.g., rotary steerable system) in accordance with one or more embodiments of the present disclosure are shown. In particular, FIG. 4 shows an interior schematic view of a directional drilling system 400, FIG. 5 shows an exterior schematic view of a motor cartridge 406 of the directional drilling system 400, FIGS. 6-8 show schematic views of switching mechanisms 442 for use with the directional drilling system 400, and FIG. 9 shows a cross-sectional view of pad assemblies 422 included within the directional drilling system 400.

In accordance with one or more embodiments of the present disclosure, one or more of the components or parts of the directional drilling system 400 may be cartridge or module based, such as to facilitate replacement of the components. For example, if a component for the directional drilling system 400 is formed as a cartridge, that component may be replaced, such as in the field (e.g., field-serviceable/replaceable), without unnecessary deconstruction of the directional drilling system 400. This configuration may allow for the components of the directional drilling system 400 to be plug and play such that components of different directional drilling systems 400 may be interchanged with one another. A cartridge for a component of the directional drilling system 400 may include a housing or sleeve with the working portions of the component included within the interior of the housing. The housing may then fit within or together with other cartridges of the directional drilling system 400. The cartridge may also include one or more ports, plugs, or other types of connectors exposed to the exterior of the housing such that these connectors may be coupled with other components of the directional drilling system 400.

Accordingly, as shown in FIG. 4, the directional drilling system 400 includes a housing 402 with a cavity 404 formed within the housing 402. The cavity 404 may be formed such that an axis of the cavity 404 is in alignment with an axis of the housing 402. A motor cartridge 406 is then removably positioned within the cavity 404 of the housing 402, such as by having the motor cartridge 406 insertable into the housing 402 through an end of the housing 402. The motor cartridge 406 includes a motor 408, such as a fluid powered motor (e.g., a progressive cavity motor), that is operably coupled to a drill bit 410 to rotate the drill bit 410 with respect to the motor cartridge 406 and/or housing 402. A drive shaft 412 may be included within the motor cartridge 406 and coupled to the drill bit 410 to rotate the drill bit 410. A bit box 414 may also be coupled between the drive shaft 412 and the drill bit 410 to facilitate connecting the drill bit 410 to the drive shaft 412.

The motor cartridge 406 may also include a transmission assembly 416, a bearing assembly 418, and/or a locking mechanism 420 positioned therein, in which one or all of these components may also be formed as a cartridge. The transmission assembly 416 is used to transfer power or rotation from the motor 408 to the drive shaft 412, and the bearing assembly 418 is positioned about the drive shaft 412 to facilitate rotation of the drive shaft 412 within the motor cartridge 406. The locking mechanism 420 may then be coupled to the motor 408, such as to selectively allow the motor 408 to rotate and provide power within the motor cartridge 406. Further, in one or more embodiments, rather than including a fully operable motor cartridge 406, a placeholder, dummy, or generally empty cartridge may be used and inserted within the cavity 404. The placeholder cartridge may have the same size, shape, and/or dimensions as the motor cartridge 406 such that the placeholder cartridge fits securely within the cavity 404. However, the placeholder cartridge may not include one or more of the elements of the motor cartridge 406 (e.g., lacks the motor 408) with the placeholder cartridge then occupying the space or void that the motor cartridge 408 would otherwise occupy. It should also be appreciated that the locking mechanism of 420 could constitute a retaining mechanism (i.e. retaining ring) at the distal end of the assembly.

The directional drilling system 400 further includes one or more pad assemblies 422 to extend from the directional drilling system 400 and engage a borehole wall to steer the directional drilling system 400 and the drill bit 410. The pad assemblies 422 each include a pad 424 and an actuator 426 (an example shown in FIG. 9), in which the actuator 426 may engage the pad 424 to extend and retract the pad 424 with respect to the housing 402 of the directional drilling system 400. The pads 424 of the pad assemblies 422 selectively extend from the exterior of the housing 402 and retract into the housing 402 to selectively engage the borehole wall.

One or more of the pad assemblies 422 may be a fluid powered pad assembly, such as by having the actuator 426 fluid powered to control movement of the pad 424. In such an embodiment, one or more flow channels 428 may be formed or positioned between the housing 402 and the motor cartridge 406 to direct fluid flow to the fluid powered pad assembly 422. For example, FIG. shows the motor cartridge 406 in which the flow channels 428 may be formed on an exterior of the motor cartridge 406. The pad assemblies 422 may then be coupled to the flow channels 428 of the motor cartridge 406 to receive fluid flow. One or more of the pad assemblies 422 may also be formed as a cartridge so that the pad assemblies 422 may be easily replaced upon failure. Accordingly, in one or more embodiments, the directional drilling system 400 may be arranged such that the pad assemblies 422 may be replaced by removing the motor cartridge 406 from the cavity 404 of the housing 402, in which the pad assemblies 422 may be accessible and replaceable through the cavity 404 of the housing 402.

Further, in addition to the pad assemblies 422, one or more rear pad assemblies 430 may be included with the directional drilling system 400. The pad assemblies 430 may be similar in design and construction to the pad assemblies 422. Accordingly, in an embodiment in which the pad assembly 430 is fluid powered, a flow channel 432 may be formed within the directional drilling system 400 to provide fluid to the pad assembly 430.

Referring still to FIG. 4, the directional drilling system 400 may further include a valve 434, an electronic control unit 436, a stabilizer 438, and/or a flex joint 440. The valve 434 and the electronic control unit 436 may be formed as a cartridge and positioned within the housing 402 of the directional drilling system 400. The valve 434 may be used to selectively route fluid flow to through the flow channels 428 and 432. The electronic control unit 436 may then be used to control the valve 434, such as based upon signals received into the directional drilling system 400, so as to move the valve 434 and route fluid into the channels 428 and 432 to move the pad assemblies 422 and/or rear pad assembly 430. The stabilizer 438 may be coupled to the housing 402, such as to stabilize and contact the borehole wall during drilling with the directional drilling system 400. Further, the flex joint 440 may be coupled to the housing 402 of the directional drilling system 400, such as to attach a drill string to the directional drilling system 400 through the flex join 440, to provide support and/or rotation to the directional drilling system 400.

In accordance with one or more embodiments of the present disclosure, the directional drilling system 400 may include one or more primary pad assemblies 422A and one or more backup pad assemblies 422B. FIG. 4 is arranged to show a primary pad assembly 422A, a backup pad assembly 422B, and even a secondary backup pad assembly 422C. Each of the pad assemblies 422A, 422B, and 422C may be selectively activated and deactivated so as to be used within the directional drilling system 400 for steering purposes. For example, when initially drilling with the directional drilling system 400, the primary pad assembly 422A may be activated, and the backup pad assembly 422B and the secondary backup pad assembly 422C may each be deactivated. As the primary pad assembly 422A is then activated, the primary pad assembly 422A may extend and retract with respect to the housing 402 to facilitate steering the directional drilling system 400. Once the primary pad assembly 422A fails or ends its useful life, the primary pad assembly 422A may be deactivated (with the primary pad assembly 422A retracted), and the backup pad assembly 422B may be activated for use with the directional drilling system 400. Similarly, once the backup pad assembly 422B then fails or ends its useful life, the backup pad assembly 422B may be deactivated (with the backup pad assembly 422B retracted), and the secondary backup pad assembly 422C may be activated for use with the directional drilling system 400. Accordingly, only one of the pad assemblies 422A, 422B, and 422C may ever be activated, thereby extending the life of the directional drilling system 400.

It may be appreciated that, while FIG. 4 only shows one primary pad assembly 422A, one backup pad assembly 422B, and one secondary backup pad assembly 422C, the present disclosure is not so limited. For example, the directional drilling system 400 may include a set of primary pad assemblies 422A, a set of backup pad assemblies 422B, and/or a set of secondary backup pad assemblies 422C. The sets of pad assemblies 422A, 422B, and 422C may then be selectively activated or deactivated altogether. Additionally or alternatively, the individual pads assemblies 422A, 422B, and 422C may be selectively activated or deactivated.

Referring now to FIGS. 6-8, multiple views of switching mechanisms 442 in accordance with one or more embodiments of the present disclosure are shown. The switching mechanisms 442 are operably coupled between the pad assemblies 422A, 422B, and/or 422C to selectively activate and deactivate the pad assemblies 422A, 422B, and/or 422C. For example, with reference to FIGS. 6 and 8, the switching mechanism 442, which may include a shuttle 444 in FIG. 6 or a ball 448 in FIG. 8, may be used and controlled to direct fluid from the flow channel 428 and between a primary pad assembly flow path 446A and a backup pad assembly flow path 446B. Fluid flow through the primary pad assembly flow path 446A may be used to activate and control the primary pad assembly 422A, and fluid flow through the backup pad assembly flow path 446B may be used to activate and control the backup pad assembly 422B. The switching mechanism 442 may then be controlled mechanically, electrically, magnetically, hydraulically, and/or using any other type of actuators, such as by using an electromagnetic signal to move the position of the shuttle 444 or the ball 448.

Further, in one or more embodiments, an indicator 450 may be used or operably coupled with the switching mechanism 442 to indicate when the switching mechanism 442 has switched to activate or deactivate the pad assemblies 422A, 422B, and/or 422C. For example, as shown in FIG. 7, an indicator 450, such as a ball, may be included within the shuttle 444 of the switching mechanism 442. When the shuttle 444 switches positions within the switching mechanism 442, the indicator 450 (e.g., the ball) may be deposited into the flow channel 428 or one of the flow paths 446A or 446B, and then work to the surface through the mud flow of the well. The ball at the surface would then indicate that the switching mechanism 442 has switched positions and, for example, that the primary pad assembly 422A has been deactivated and the backup pad assembly 422B has been activated.

In one or more embodiments, a sensor 452, as shown in FIGS. 6 and 8, may be included within the directional drilling system 400 to measure a condition of one or more of the pad assemblies 422A, 422B, and/or 422C. The sensor 452 as shown is positioned adjacent to the switching mechanism 442 and/or the pad assemblies 422A, 422B, and/or 422C. The sensor 452 may then measure a condition of one or more of the pad assemblies 422A, 422B, and/or 422C, such as to determine if the pad assemblies 422A, 422B, and/or 422C need to be activated or deactivated. In one embodiment, the sensor 452 may measure a condition related to the pad assemblies 422A, 422B, and/or 422C, and the measured condition may be compared to a predetermined value to determine if the pad assemblies 422A, 422B, and/or 422C need to be deactivated. For example, the sensor 452 may be a pressure sensor to measure fluid pressure adjacent the switching mechanism 442 and/or the pad assemblies 422A, 422B, and/or 422C. If the fluid pressure is above a predetermined value, this may indicate that the pad assemblies 422A, 422B, and/or 422C have a leak, and therefore the current activated pad assembly needs to be deactivated and the next backup pad assembly needs to be activated.

Referring now specifically to FIG. 9, a cross-sectional view of the pad assemblies 422 included within the directional drilling system 400 is shown. In accordance with one or more embodiments of the present disclosure, the pad assemblies 422 may be asymmetrically arranged (e.g., not equally spaced) within the directional drilling system 400. The asymmetrical arrangement of the pad assemblies 422 may be used to mitigate vibration imparted to the directional drilling system 400, particularly during drilling. The pad assemblies 422 may be asymmetrically arranged about an axis of the directional drilling system 400 and/or housing 402, and/or may be asymmetrically along the axis of the directional drilling system 400 and/or housing 402. For example, in an embodiment in which the directional drilling system 400 includes a set of three primary pad assemblies 422A, the three primary pad assemblies 422A may not each be positioned 120 degrees from each other. Similarly, in an embodiment in which the directional drilling system 400 includes a set of four primary pad assemblies 422A, the four primary pad assemblies 422A may not each be positioned 90 degrees from each other, and in an embodiment in which the directional drilling system 400 includes a set of five primary pad assemblies 422A, the five primary pad assemblies 422A may not each be positioned 72 degrees from each other. The asymmetrical arrangement of the pad assemblies 422 are force balanced for the directional drilling system 400 (e.g., arranged to be counter-balanced when applying force to the directional drilling system 400).

In addition to the embodiments described above, many examples of specific combinations are within the scope of the disclosure, some of which are detailed below:

Example 1

A directional drilling system, comprising:
a housing;
a motor positioned within the housing to rotate a drill bit;
a primary pad assembly comprising a primary pad and a primary actuator coupled to the primary pad to selectively extend from an exterior of the housing; and
a backup pad assembly to back up the primary pad assembly, the backup pad assembly comprising a backup pad and a backup actuator coupled to the backup pad to selectively extend from the exterior of the housing.

Example 2

The system of Example 1, wherein the primary pad assembly and the backup pad assembly are each selectively activatable and deactivatable.

Example 3

The system of Example 2, wherein, when one of the primary pad assembly and the backup pad assembly is activated, the other of the primary pad assembly and the backup pad assembly is deactivated.

Example 4

The system of Example 2, further comprising a switching mechanism operably coupled to the primary pad assembly and the backup pad assembly to selectively activate and deactivate the primary pad assembly and the backup pad assembly.

Example 5

The system of Example 1, further comprising a sensor operably coupled to the primary pad assembly to measure a condition related to the primary pad assembly.

Example 6

The system of Example 1, further comprising a plurality of primary pad assemblies and a plurality of backup pad assemblies.

Example 7

The system of Example 6, wherein the plurality of primary pad assemblies are asymmetrically arranged with respect to an axis of the housing.

Example 8

The system of Example 1, wherein the housing comprises a cavity within the housing, the system further comprising:
a motor cartridge comprising the motor and removably positionable within the cavity of the housing.

Example 9

The system of Example 8, wherein the motor comprises a fluid powered motor and at least one of the primary pad assembly and the backup pad assembly comprises a fluid powered pad assembly.

Example 10

The system of Example 9, wherein a flow channel is formed between the housing and the motor cartridge so as to direct fluid flow to the fluid powered pad assembly.

Example 11

The system of Example 10, wherein:
the flow channel is formed on an exterior of the motor cartridge; and the fluid powered pad assembly is fluidly coupled to the flow channel of the motor cartridge.

Example 12

The system of Example 8, wherein at least one of the primary pad assembly and the backup pad assembly is removable from the directional drilling system when the motor cartridge is removed from the cavity of the housing.

Example 13

The system of Example 8, wherein the motor cartridge further comprises a drive shaft with the drill bit coupled to the drive shaft to rotate the drill bit.

Example 14

A method to drill with a directional drilling system, the method comprising:
drilling with a drill bit operably coupled to a motor of the directional drilling system;
retracting a primary pad of a primary pad assembly into a housing of the directional drilling system; and
extending a backup pad of a backup pad assembly from an exterior of the housing to apply a steering force to the drill bit.

Example 15

The method of Example 14, wherein:
the retracting the primary pad comprises deactivating the primary pad assembly; and
the extending the backup pad comprises activating the backup pad assembly.

Example 16

The method of Example 15, further comprising:
measuring a condition of the primary pad assembly; and
comparing the measured condition with a predetermined value to determine to deactivate the primary pad assembly.

Example 17

The method of Example 14, further comprising:
inserting a motor cartridge comprising the motor into a cavity of the housing of the directional drilling system.

Example 18

The method of Example 17, wherein the extending the backup pad comprises directing fluid pressure along a flow channel formed between the housing and the motor cartridge.

Example 19

The method of Example 14, further comprising extending and retracting each of a plurality of primary pads of a plurality of primary pad assemblies with respect to the exterior of the housing, the primary pad assemblies being asymmetrically arranged with respect to an axis of the housing and force balanced for the directional drilling system.

Example 20

A directional drilling system, comprising:
a housing comprising a cavity formed within the housing;
a motor cartridge comprising a motor and a drive shaft, the motor cartridge
removably positioned within the cavity of the housing, the motor operably coupled to a drill bit to rotate the drill bit; and
a pad assembly comprising a pad and an actuator, the pad extendable from an exterior of the housing to apply a steering force to the drill bit.

This discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to intimate that the scope of the disclosure, including the claims, is limited to that embodiment.

Certain terms are used throughout the description and claims to refer to particular features or components. As one skilled in the art will appreciate, different persons may refer to the same feature or component by different names. This document does not intend to distinguish between components or features that differ in name but not function, unless specifically stated. In the discussion and in the claims, the terms "including" and "comprising" are used in an open-ended fashion, and thus should be interpreted to mean "including, but not limited to . . . " Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. The use of "top," "bottom," "above," "below," and variations of these terms is made for convenience, but does not require any particular orientation of the components.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Although the present invention has been described with respect to specific details, it is not intended that such details should be regarded as limitations on the scope of the invention, except to the extent that they are included in the accompanying claims.

What is claimed is:

1. A directional drilling system for use with a drill bit, comprising:

a housing;

a motor positioned within the housing to rotate the drill bit;

a first pad assembly comprising a first pad and a first actuator coupled to the first pad to selectively extend from an exterior of the housing; and a second pad assembly, the second pad assembly comprising a second pad and a second actuator coupled to the second pad to selectively extend from the exterior of the housing, the second pad assembly azimuthally aligned with and spaced axially apart from the first pad assembly with respect to a longitudinal axis of the housing.

2. The system of claim 1, wherein the first pad assembly and the second pad assembly are each selectively activatable and deactivatable.

3. The system of claim 2, wherein, when one of the first pad assembly and the second pad assembly is activated, the other of the first pad assembly and the second pad assembly is deactivated.

4. The system of claim 2, further comprising a switching mechanism operably coupled to the first pad assembly and the second pad assembly to selectively activate and deactivate the first pad assembly and the second pad assembly.

5. The system of claim 1, further comprising a sensor operably coupled to the first pad assembly to measure a condition related to the first pad assembly.

6. The system of claim 1, further comprising a plurality of first pad assemblies and a plurality of second pad assemblies.

7. The system of claim 6, wherein the plurality of first pad assemblies are asymmetrically arranged with respect to an axis of the housing.

8. The system of claim 1, wherein the housing comprises a cavity within the housing, the system further comprising: a motor cartridge comprising the motor and removably positionable within the cavity of the housing.

9. The system of claim 8, wherein the motor comprises a fluid powered motor and at least one of the first pad assembly and the second pad assembly comprises a fluid powered pad assembly.

10. The system of claim 9, wherein a flow channel is formed between the housing and the motor cartridge so as to direct fluid flow to the fluid powered pad assembly.

11. The system of claim 10, wherein: the flow channel is formed on an exterior of the motor cartridge; and the fluid powered pad assembly is fluidly coupled to the flow channel of the motor cartridge.

12. The system of claim 8, wherein at least one of the first pad assembly and the second pad assembly is removable from the directional drilling system when the motor cartridge is removed from the cavity of the housing.

13. The system of claim 8, wherein the motor cartridge further comprises a drive shaft with the drill bit coupled to the drive shaft to rotate the drill bit.

14. A method to drill with a directional drilling system, the method comprising:

drilling with a drill bit operably coupled to a motor of the directional drilling system;

retracting a first pad of a first pad assembly with a first actuator into a housing of the directional drilling system; and extending a second pad of a second pad assembly with a second actuator from an exterior of the housing to apply a steering force to the drill bit, the second pad assembly azimuthally aligned with and axially spaced apart from the first pad assembly with respect to a longitudinal axis of the housing.

15. The method of claim 14, wherein: the retracting the first pad comprises deactivating the first pad assembly; and the extending the second pad comprises activating the second pad assembly.

16. The method of claim 15, further comprising: measuring a condition of the first pad assembly; and comparing the measured condition with a predetermined value to determine to deactivate the first pad assembly.

17. The method of claim 14, further comprising: inserting a motor cartridge comprising the motor into a cavity of the housing of the directional drilling system.

18. The method of claim 17, wherein the extending the second pad comprises directing fluid pressure along a flow channel formed between the housing and the motor cartridge.

19. The method of claim 14, further comprising extending and retracting each of a plurality of first pads of a plurality of first pad assemblies with respect to the exterior of the housing, the first pad assemblies being asymmetrically arranged with respect to an axis of the housing and force balanced for the directional drilling system.

20. A directional drilling system, comprising:

a housing comprising a cavity formed within the housing;

a motor cartridge comprising a motor and a drive shaft, the motor cartridge removably positioned within the cavity of the housing, the motor operably coupled to a drill bit to rotate the drill bit;

a first pad assembly comprising a first pad and a first actuator, the first pad extendable from an exterior of the housing to apply a first steering force to the drill bit; and a second pad assembly comprising a second pad and a second actuator, the second pad extendable from an exterior of the housing to apply a second steering force to the drill bit, wherein the second pad assembly is azimuthally aligned with and axially spaced apart from the first pad assembly with respect to a longitudinal axis of the housing.

* * * * *